US005863031A

United States Patent [19]

Veeder et al.

[11] Patent Number: 5,863,031

[45] Date of Patent: Jan. 26, 1999

[54] CERAMIC DIFFUSER ASSEMBLY

[75] Inventors: Richard K. Veeder, Pittsford; Philip S. Way, Naples; Richard J. Lorge, Victor, all of N.Y.

[73] Assignee: Ferro Corporation, Cleveland, Ohio

[21] Appl. No.: 856,408

[22] Filed: May 14, 1997

[51] Int. Cl.[6] ..... B01F 3/04

[52] U.S. Cl. ..... 261/122.1; 261/DIG. 70

[58] Field of Search ..... 261/122.1, DIG. 47, 261/DIG. 70; 239/57

[56] References Cited

U.S. PATENT DOCUMENTS

| | | | |
|---|---|---|---|
| 2,294,973 | 9/1942 | Ford | 261/122.1 |
| 2,518,746 | 8/1950 | Blohm et al. | 261/122.1 |
| 2,639,131 | 5/1953 | Coombs | 261/122.1 |
| 3,970,731 | 7/1976 | Oksman | 261/122.1 |
| 4,046,845 | 9/1977 | Veeder | 261/122.1 |
| 4,569,805 | 2/1986 | Hume et al. | 261/122.1 |
| 4,629,591 | 12/1986 | Forsyth | 261/122.1 |
| 4,865,778 | 9/1989 | Leidel | 261/122.1 |
| 5,075,048 | 12/1991 | Veeder | 261/122.1 |
| 5,082,518 | 1/1992 | Molinaro | 156/345 |
| 5,215,686 | 6/1993 | Sheckler et al. | 261/122.1 |

*Primary Examiner*—C. Scott Bushey
*Attorney, Agent, or Firm*—Rankin, Hill, Porter & Clark LLP

[57] ABSTRACT

A gas diffuser assembly adapted for location in a volume of liquid or semiliquid material for dispersing minute bubbles of gas into the liquid. The assembly includes a housing formed of dense impermeable ceramic material and which defines an upwardly facing recess. A fitting formed of an inert material is located in the floor of the recess for connection to a gas supply tube. A diffuser element formed of porous ceramic material is secured to the housing over the recess to define an enclosed gas chamber. The diffuser disk and the housing are adhered together with a suitable cement.

17 Claims, 3 Drawing Sheets

CERAMIC DIFFUSER ASSEMBLY

FIELD OF THE INVENTION

The present invention concerns a diffuser for diffusing gases into liquid mediums. More particularly, the present invention concerns a ceramic diffuser assembly that is capable of withstanding adverse environmental conditions.

BACKGROUND OF THE INVENTION

This invention relates to the introduction of a gaseous medium in the form of minute bubbles into a volume of liquid, and especially to a gas diffuser for diffusing a gas into a liquid. More particularly, the invention relates to a device for diffusing a gas such as ozone, into water for purposes of purifying the water.

In the treatment of water, water is normally collected in a large pond, tank, or basin. The particular receptacle generally has a manifold structure near the bottom with a series of gas supply tubes arranged in a suitable array. A number of diffuser heads are located along each supply tube to provide a uniform pattern of gas dispersion throughout the lower portion of the volume of the water that is being treated.

The principal operative component of each diffuser head is a gas permeable element communicating with a gas chamber within the head. Gas under pressure is supplied to all the gas supply tubes causing pressurized gas to fill the diffuser head gas chamber. Consequently, gas is forced through the interstices of the porous diffuser element into the water to form minute bubbles or microbubbles.

The diffuser element or sparger is generally formed of a gas permeable, porous material. Generally speaking, the finer the bubbles that can be diffused into the water the better, so that the surface area of gas exposed to the liquid is optimized.

One problem encountered in connection with the use of a gas such as ozone is the highly corrosive nature of the gas itself. The use of most metals and/or organic plastic components in the diffuser head, eventually results in corrosion damage and failure. However, prior art diffuser assemblies have necessarily required some metal components (such as bolts or other threaded fasteners) and some organic components (such as elastomeric seal rings, etc.) that are susceptible to deterioration.

Because of the corrosive nature of ozone, it has been found that an advantageous material for the diffuser is a porous ceramic. This material is inorganic and not vulnerable to the corrosive effects of either the sewage or of ozone gas. One type of diffuser made from porous ceramic material is described in U.S. Pat. No. 4,046,845. That device essentially comprises two components comprising a relatively dense base portion that may be formed of a PVC plastic material or stainless steel, and a porous ceramic diffuser element in the form of a relatively flat circular plate that seats in an annular groove or rabbet formed in the base member. The base member and the interior surface of the ceramic diffuser element define an interior chamber that is supplied with gas through an inlet tube connected to a gas supply pipe.

In this device, a seal ring formed of organic material, such as an elastomer, is positioned at the joint between the base and the outer edge of the ceramic diffuser plate. A threaded metal fastener extends through a central opening in the ceramic plate and is anchored to the base. The fastener is formed of steel and has an organic seal ring positioned between the fastener head and the upper surface of the ceramic plate.

The advantage of this construction is that the porous ceramic material provides an excellent means for diffusing minute bubbles into the liquid being treated, while at the same time, being formed of material that resists the corrosive effects of the environment including reactive gases that are being diffused. One disadvantage of this construction, however, is that the diffuser assembly includes components that are formed of materials that are vulnerable, over a period of time, to the corrosive effects of the environment it is being used in.

The device of the present invention, however, eliminates the difficulties described above and provides an improved diffuser head assembly of simpler construction that resists the corrosive effects referred to above.

SUMMARY OF THE INVENTION

The present invention provides an improved gas diffuser for introducing minute bubbles into a volume of liquid, wherein the diffuser element and housing are formed entirely of materials that resist the corrosive effects of chemical compounds and of highly reactive gases such as ozone.

The present invention provides an improved gas diffuser assembly adapted for location in a volume of liquid or semiliquid material (e.g., drinking water, sewage or chemicals) for dispersing minute bubbles of gas into the liquid.

The diffuser has a housing formed of a dense impermeable ceramic material, and it includes a floor surrounded by a generally continuous vertical wall. The floor and wall define an upwardly facing recess. Located in the floor is an opening adapted to receive an inlet or orifice fitting formed of a nonreactive material (e.g., a dense ceramic or an inert polymer such as a fluorinated polymer). The fitting is adapted to receive a conduit or pipe that supplies gas under pressure from a pressure source through the inlet fitting to the recess.

Located over the top of the recess is a diffuser element formed of porous ceramic material. The diffuser element is in the shape of relatively flat plate or disk. The diffuser element is secured to the housing with a suitable cement. In this way, the housing and diffuser element define an enclosed gas chamber adapted to receive gas under pressure through the inlet fitting. The gas is dispersed through the porous diffuser element into the volume of liquid in the form of minute bubbles.

DESCRIPTION OF THE PREFERRED EMBODIMENTS

Figure 1A:
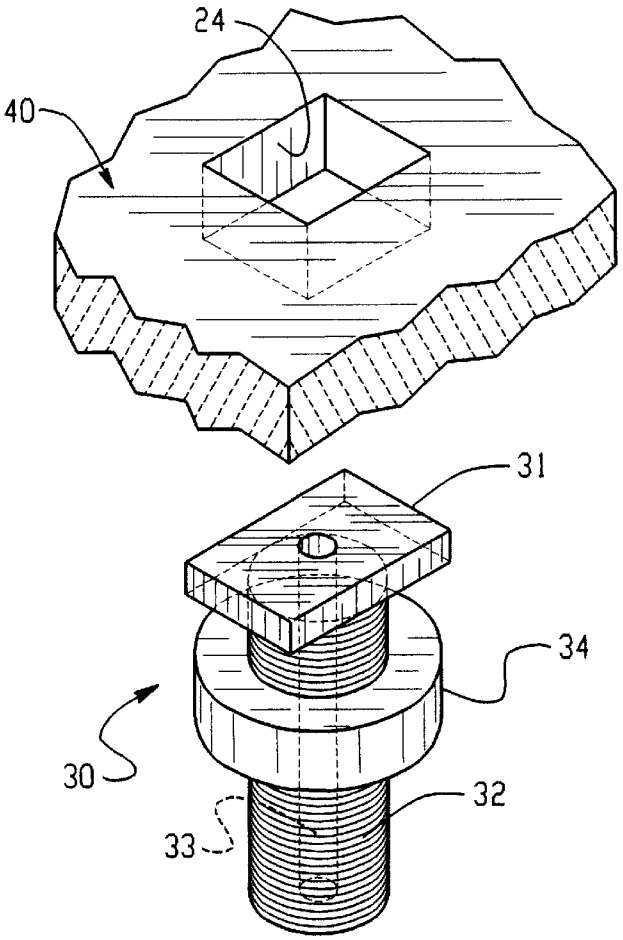
FIG. 1A is a further broken away perspective view of the diffuser shown in FIG. 1.
Figure 1:
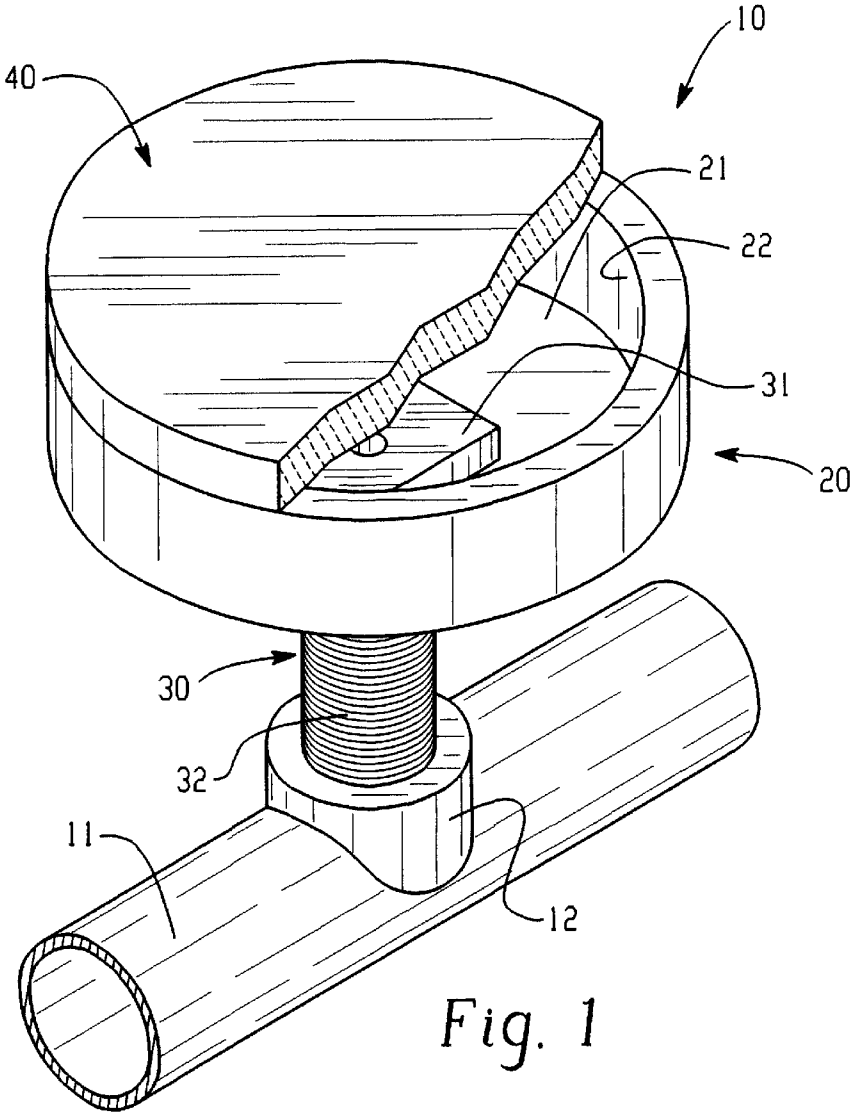
FIG. 1 is a perspective view illustrating a gas diffuser embodying the invention and attached to a gas supply pipe, with parts broken away and shown in section for the purpose of illustration.

Referring more particularly to the drawings, there is shown a gas diffuser assembly 10 embodying the invention and adapted for location in a volume of liquid or semiliquid material such as water or a liquid chemical. The diffuser is adapted to distribute minute bubbles or microbubbles into the surrounding liquid for the purpose of purifying or otherwise treating the liquid. The diffuser is adapted to be located at the bottom of the volume of liquid, (i.e., in a settling pond, tank, or basin) so as to provide a maximum time period during which the bubbles rise upward through the liquid while maintaining surface contact with the liquid so as to optimize the ensuing chemical reaction or treatment. The diffuser assembly 10 is particularly adapted for use in a system wherein a highly reactive gas such as ozone gas is to be dispersed in a liquid. The ozone provides an efficient reactant for purifying the volume of liquid in accordance with standard water treatment processes.

As indicated above, the use of ozone gas or other reactive gases presents certain problems as to the diffuser, in that the gas, being highly reactive, will cause rapid corrosion of many metal components and most organic components of the diffuser. However, the diffuser assembly of the present invention avoids these problems.

The diffuser assembly 10 is adapted for connection to a gas supply tube 11 with a threaded fitting 12. The tube 11 is adapted to supply a suitable gas under pressure from a gas pressure source.

In accordance with the invention, the diffuser assembly 10 includes as its primary elements a housing 20 formed of a dense impermeable ceramic material (e.g., a conventional dense alumina ceramic), an inlet or orifice fitting 30 formed of an inert material (e.g., an organic polymer or a ceramic material), and a diffuser plate or element 40 formed of a porous ceramic material (e.g., a conventional bonded fused alumina). The inert material preferably comprises a fluorinated polymer. Preferably, the fluorinated polymer comprises polytetrafluoroethylene. Commercial polytetrafluoroethylene is sold under the trademark TEFLON.

Figure 2:
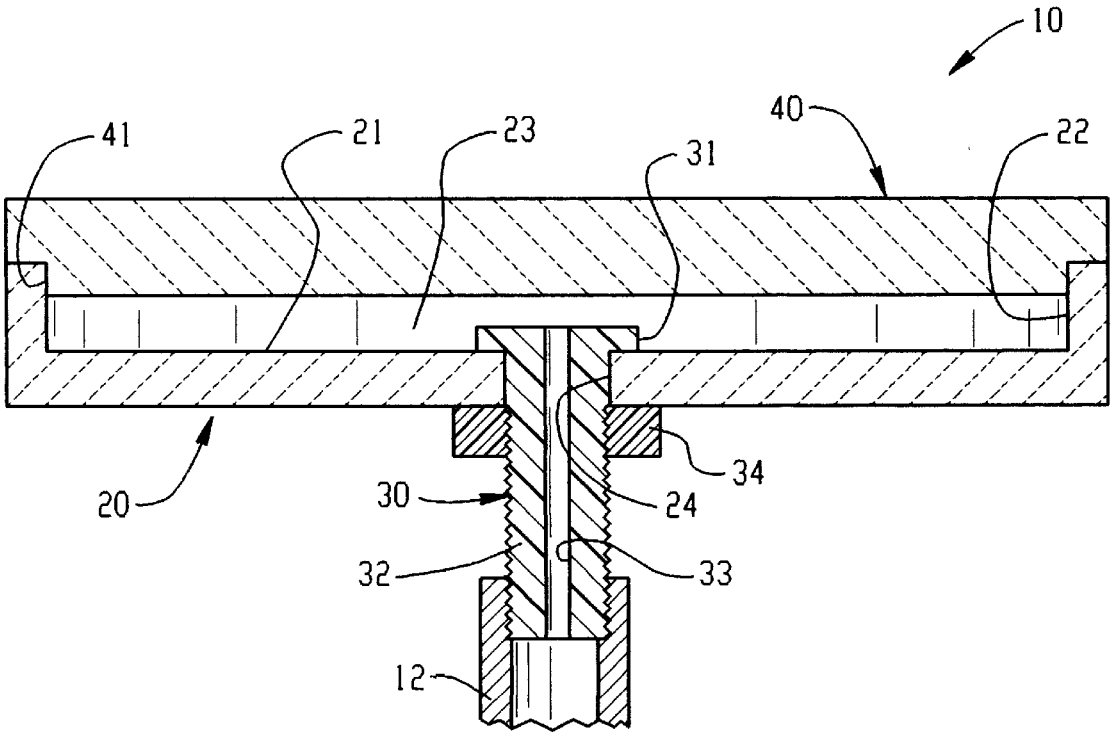
FIG. 2 is a sectional view through the center of the diffuser shown in FIG. 1.

The housing 20 has a floor 21 and a continuous vertical wall 22 that defines the outer edges of the floor. The floor and wall 22 define an upwardly facing cavity or recess 23 (FIG. 2).

Located in the floor 21 in the center of the recess 23 is an opening 24 which is adapted to receive the inlet or orifice fitting 30. The fitting 30 has a top flange 31, the bottom surface of which rests against the interior surface of the floor 21. Also the fitting has a threaded shank or stem 32 that defines a central passage 33 extending its full length and communicating with the recess 23. Preferably, as seen best in FIG. 1A top flange 31 and opening 24 are rectangular in shape so as to permit the fitting 30 to be mounted after the diffuser element 40 has been secured to housing 20. In this manner of mounting, no part or fitting 30 extends above diffuser element 40, and thus fitting 30 does not in anyway interfere with the flow of gas out of the element 40.

The orifice fitting 30 is secured to the floor 21 of the housing 20 by means of a threaded nut 34 formed of an inert organic polymer material such as TEFLON, which bears against the bottom exterior surface of the floor 21. The lower end of the threaded stem 32 is threaded into the fitting 12 of the gas supply tube 11. With this arrangement, it will be seen that the gas conveyed through the gas supply tube 11 will pass upwardly through the central passage 33 and into the chamber or recess 23.

The diffuser element 40 is located over the top of the recess 23 and preferably has a circumferential rabbet 41 formed therein. The rabbet is adapted to receive the interior top portion of the wall 22. The element 40 is secured to the wall 22 of housing 20 using a suitable cement such as an inorganic cement so as to define within the housing an interior gas chamber 42. The cement may be applied to the pieces while they are in a green state and then cofired with such pieces. Alternatively, the cement may be applied after the pieces are fired (i.e., applied post fired), and then the pieces and cement would be subjected to a separate additional firing. One suitable cement is a calcium aluminate cement distributed by the LaFarge Fondu Company of Chesapeake, Va. Another suitable cement is a silicate cement sold by the Sauereisen Company of Pittsburgh, Penn. Additionally, it will be appreciated that the cement may comprise a glass or glass/ceramic based cement or binder. For example, the cement may comprise an alumina silicate glass and other oxides to approximate the thermal expansion and firing temperatures of the diffuser element 40 and housing 20.

Figure 2A:
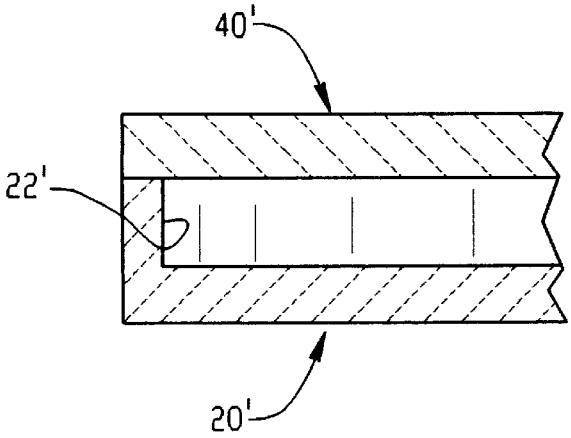
FIG. 2A is a broken sectional view showing a modified configuration of FIG. 2 with similar elements being indicated with a prime designation.

The sealing connection between the housing and diffuser element 40 as shown in FIG. 2 may be achieved through the forming of the annular rabbet 41 around the lower edge of the diffuser element. Accordingly, the stress caused by the gas pressure acts in shear at the joint between the wall 22 and the outer edge of the diffuser element. This provides a much stronger joint than would be obtained if the rabbet were not provided and the diffuser element was merely adhered by cement to the top surface of the cylindrical wall 22. However, it must be appreciated that the present invention also contemplates as shown in FIG. 2A a joint without the rabbet such that the diffuser element 40' sits on top of the wall 22' of the housing 20', the cement providing a bond between the interface of the wall 22' and housing 20'.

As indicated above, the diffuser element 40 is formed of a porous ceramic material so that gas under pressure within the gas chamber will be forced in an upward direction through the interstices in the porous ceramic material and dispersed in the form of minute bubbles in the volume of liquid surrounding the diffuser 10.

It will be noted that the three components including the housing 20, orifice fitting 30, and diffuser element 40 of the gas diffuser 10 are all formed of an inert material that is not vulnerable to the corrosive effect of either the liquid being treated or the highly reactive gases such as ozone, that may be used in a treatment process. Thus, there is provided a gas diffuser assembly suitable for use in a highly corrosive liquid and adapted to diffuse a highly reactive gas while resisting such corrosion, due to the relatively inert character of the materials used for the various components.

It will also be appreciated that the present invention contemplates that the shape of the diffuser element 40 and the housing 20 may be other than a circular shape as shown. For example, the element and housing could be square or rectangular in shape. It will further be appreciated that in addition to an inert organic material, fitting 30 may also be formed of a dense ceramic material such as conventional dense alumina. The alumina fitting may be mechanically attached with a threaded nut made of inert organic material or a ceramic material such as conventional dense alumina, or alternatively such fitting could be attached using an inorganic cement as described above in connection with the diffuser element 40 and housing 20.

Figure 3:
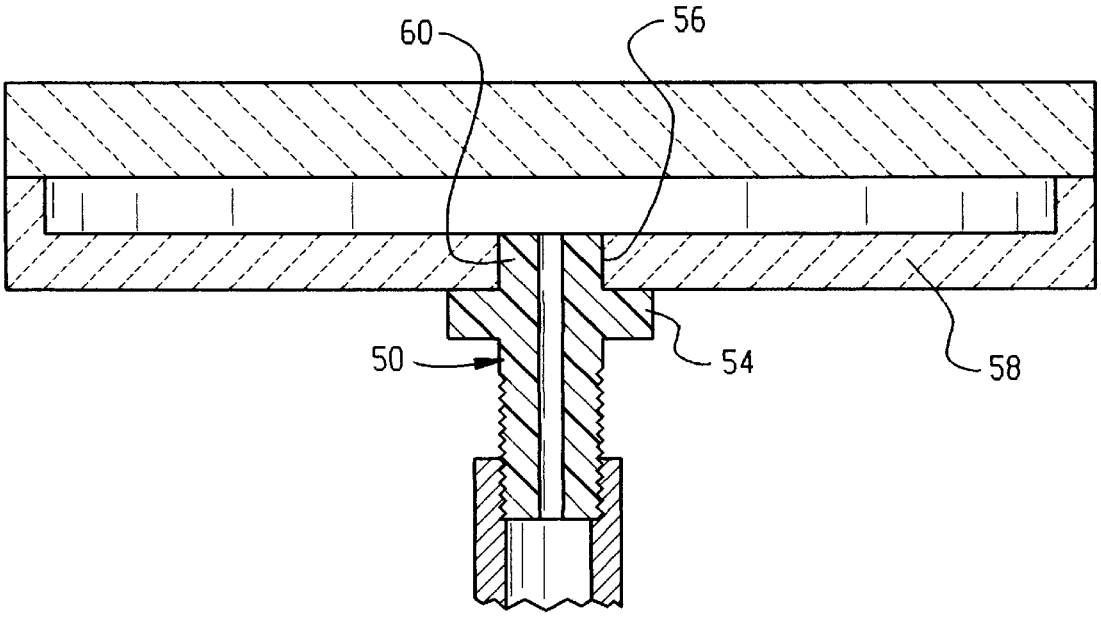
FIG. 3 is a sectional view through the center of another diffuser assembly made in accordance with the present invention.

Referring now to FIG. 3 there is yet another embodiment of the invention shown which employs an inlet or orifice fitting 50 as described above formed entirely of a dense ceramic material such as conventional dense alumina. Formed at the top of the fitting 50 is a flange 54. An opening 56 is formed in the bottom of housing 58 to accommodate the top portion of the orifice fitting 50. A suitable cement, as described above, is used to bond the housing 58 to the orifice fitting 50 throughout the edges of opening 56 and the top of flange 54. Opening 56 and the topmost portion 60 of orifice 50 are preferably circular in shape, however, it will be appreciated that they may also be square, rectangular or irregular in shape so long as a snug fitting matting surface is provided.

While the invention has been shown and described with respect to specific embodiments thereof, this is intended for the purpose of illustration rather than limitation and other variations and modifications of the specific device herein shown and described will be apparent to those skilled in the art all within the intended spirit and scope of the invention. Accordingly, the present invention is not to be limited in scope and effect to the specific embodiments herein shown and described nor in any other way that is inconsistent with the extent to which the progress in the art has been advanced by the present invention.

We claim:

1. A gas diffuser assembly for dispersing a gas in the form of minute bubbles into a volume of liquid comprising:

a housing formed of dense ceramic material, said housing having a floor with a central inlet opening formed therein, and a wall surrounding said floor, said wall having a top portion, an inlet fitting secured to said floor, and a diffuser plate formed of a porous ceramic material, and having upper external and lower internal surfaces, said plate being sealingly secured to the top portion of said wall with a cement so that said lower internal surface of said plate defines with said wall and floor a sealed gas chamber adapted to receive gas under pressure through said inlet fitting, to be diffused through said plate into the volume of liquid.

2. A gas diffuser assembly as defined in claim 1 wherein said plate has an annular rabbet formed around said lower internal surface and wherein the top portion of said wall fits in said rabbet and is secured therein.

3. A gas diffuser assembly as defined in claim 1 wherein said plate is secured to said wall with an inorganic cement.

4. A gas diffuser assembly as defined in claim 2 wherein said wall and said plate are circular.

5. A gas diffuser assembly as defined in claim 1 wherein said inlet fitting comprises a material selected from the group consisting of an inert polymer and a dense ceramic.

6. A gas diffuser assembly as defined in claim 5 wherein said inert polymer of said inlet fitting comprises a fluorinated polymer.

7. A gas diffuser assembly as defined in claim 1 wherein said gas comprises a reactive gas.

8. A gas diffuser assembly as defined in claim 1 wherein said liquid comprises water, sewage or a liquid chemical.

9. A gas diffuser assembly as defined in claim 1 wherein said diffuser plate comprises a porous bonded fused alumina.

10. A gas diffuser assembly as defined in claim 1 wherein said housing comprises a dense alumina ceramic.

11. A gas diffuser assembly as set forth in claim 3 wherein said cement comprises an inorganic cement selected from the group consisting of a calcium aluminate cement, a silicate cement, a glass cement and a glass/ceramic cement.

12. A gas diffuser assembly as set forth in claim 1 wherein said inlet fitting is secured to said floor of said housing with a nut formed of a material selected from the group consisting of an inert polymer and a dense ceramic.

13. A gas diffuser assembly as set forth in claim 12 wherein said inert polymer of said nut comprises polytetrafluoroethylene.

14. A gas diffuser assembly as set forth in claim 1 wherein said inlet fitting does not extend above said lower internal surface of said diffuser plate.

15. A gas diffuser assembly for dispersing a gas in the form of minute bubbles into a volume of liquid comprising:

a housing formed of dense ceramic material, said housing having a floor with a central inlet opening formed therein, and a wall surrounding said floor, said wall having a top portion, an inlet fitting secured to said floor, said inlet fitting comprising dense ceramic and said fitting being attached to said floor of said housing using an inorganic cement, and a diffuser plate formed of a porous ceramic material, and having upper external and lower internal surfaces, said plate being sealingly secured to the top portion of said wall with a cement so that said lower internal surface of said plate defines with said wall and floor a sealed gas chamber adapted to receive gas under pressure through said inlet fitting, to be diffused through said plate into the volume of liquid.

16. A gas diffuser assembly as set forth in claim 15 wherein said dense ceramic of said inlet fitting comprises a dense alumina ceramic.

17. A gas diffuser assembly as set forth in claim 15 wherein said inorganic cement comprises a material selected from the group consisting of a calcium aluminate cement, a silicate cement, a glass cement and a glass/ceramic cement.

* * * * *